US005526578A

United States Patent [19]

Iyer

[11] Patent Number: 5,526,578

[45] Date of Patent: Jun. 18, 1996

[54] COMB-TYPE HAIR DRYER

[76] Inventor: Ramanathan K. Iyer, 3108 Seaway Ct., #305, Tampa, Fla. 33629

[21] Appl. No.: 442,820

[22] Filed: May 17, 1995

[51] Int. Cl.[6] ..... A45D 20/12

[52] U.S. Cl. ..... 34/97; 34/98; 34/99; 239/443; 239/445

[58] Field of Search ..... 34/96, 97, 98, 34/99, 283; 239/443, 445, 504, 562

[56] References Cited

U.S. PATENT DOCUMENTS

| | | | |
|---|---|---|---|
| 4,138,827 | 2/1979 | Baugh et al. | 34/98 |
| 4,620,374 | 11/1986 | Patterson | 34/97 |
| 4,674,260 | 6/1987 | Paulhus et al. | 34/98 |
| 4,692,594 | 9/1987 | Martin | 34/97 |
| 5,067,444 | 11/1991 | Parker | 34/97 |
| 5,133,043 | 7/1992 | Baugh | 34/97 |
| 5,261,427 | 11/1993 | Dolev | 34/98 |

*Primary Examiner*—John T. Kwon
*Attorney, Agent, or Firm*—Dominik & Stein

[57] ABSTRACT

A generally disk-shaped comb-type hair dryer with drying air discharge nozzles projecting from a concave bottom surface. The bottom surface of the disk shaped hair dryer housing is gently concave in a manner to ergonomically conform the distal ends of the discharge nozzles to the outer contour of the human head. Heated air is emitted from the hair dryer discharge nozzles at the level of, or immediately above the level of, the scalp and is directed parallel to the scalp or upwardly such that there is no waste of air flow, no waste of heat, great efficiency in drying and no irritation of the scalp. The flow of air away from the scalp produces a fuller bodied hair style.

16 Claims, 8 Drawing Sheets

COMB-TYPE HAIR DRYER

BACKGROUND OF THE INVENTION

1. Field of the Invention

The present invention is directed to a hair dryer in which the air flow is ducted in a new manner so as to reduce power consumption and noise, while at the same time protecting the scalp from overheating.

2. Description of the Related Art

Conventional hand held hair dryers provide a strong flow of heated air, and this is necessary due to the preconceived theory of operation. Namely, it is understood by those in the art that the flow of air must be sufficiently intense that the air travels the distance from the hair dryer to the hair (usually about six inches), and then still be strong enough to penetrate through the hair to dry even the hair closest to the scalp. Since the scalp may be covered by as much as an inch of hair, the conventional hair dryer is engineered so as to be capable of penetrate a one inch layer of hair.

Obviously, not everyone has this much hair, and for those with less hair, the feeling of hot air blowing on the scalp is uncomfortable at best, and localized overheating and overdrying is injurious to the scalp and hair root system at worst.

Animal groomers have a similar problem, in that animals can not talk or complain when they are uncomfortable during grooming, and a powerful jet of hot air blowing on the skin of the animal irritates the animal. An uncomfortable animal is difficult to groom.

The most common response to this problem involves the provision of diffusers. Diffusers are attached to the air outlet of a hair dryer in order to diffuse and soften the flow of air. For example, U.S. Pat. No. 4,759,135 (Scivoletto) teaches an air diffuser and hair lifter attachment for a blow dryer, wherein the attachment functions to lower the velocity and to diffuse the air flow. A plurality of hair lifters are provided so that the hair can be lifted while being dried, resulting in more body. However, the diffuser is merely an attachment to a conventional blow dryer, and thus there is no reduction in power consumption. Further, the flow of air remains directed onto the scalp, so that there is no protection of the scalp.

U.S. Pat. No. 4,848,007 (Montagnio) teaches a diffuser attachment for a hair dryer, in which cooler ambient air is mixed into the stream of hot air exiting from the hair dryer during use. This reduces the likelihood of overheating of the scalp. However, this attachment merely increases the inefficiency of the hair dryer.

U.S. Pat. No. 4,295,283 (Tomaro) teaches a diffuser attachment for a hair dryer. Included in the diffuser is a freely rotating fan, such that air passing through the diffuser will cause the fan to rotate, breaking up the air flow, and dispersing the air flow into a plurality of diversely directed air currents. Finger-like projections can be used as spacers to insure that the hair dryer is kept a predetermined distance from the head. This diffuser adheres to the notion that hot air from the hair dryer must be blown onto the head.

Recently, U.S. Pat. No. 5,275,339 (Andis et al) disclosed a hair dryer diffuser including a grill defining a number of discharge openings, and a plurality of generally hollow fingers extending from the grill. The fingers define respective finger passageways and discharge openings. A valve regulates the balance of air flow between the grill discharge openings and the finger discharge openings. The fingers are so constructed that the air flow leaving the fingers is directed generally coaxially with the fingers and general air flow (see FIG. 4). Further, the main air flow from the grill discharge openings is directed down onto the scalp. Further yet, this patent merely discloses a diffuser attachment for attaching to a conventional hair dryer, so that no improvement in energy savings can be realized.

Finally, U.S. Pat. No. 5,235,759 (Rizzuto, Jr.) teaches a reversible diffuser for a hair dryer. The diffuser comprises a main body with a removable and reversible air outlet plate. When the air outlet plate is in a first orientation, the outward appearance is of a series of holes. When the plate is removed and inverted, the appearance is of a series of vent orifices with a number of finger-like projections interspersed. The bulk of the air flow is directed out of the vent orifices onto the scalp, while a minor portion of the air flow is directed through the fingers, out air openings at the ends of the fingers, and onto the scalp (see FIG. 2). Again, no improvement in economy over a conventional hair dryer is envisioned, and air flow remains directed onto the scalp, as is consistent with the prevailing theory of hair drying.

Although the above-discussed diffusers are capable of dissipating the mainstream of air from a blow dryer into a plurality of smaller and gentler anticurrents, and while they do permit comfortably holding the hand-held hair dryer closer to the scalp, they all nevertheless retain a number of disadvantages. First, the electrical power supply for a conventional hair dryer is rather significant, and no cost saving is associated with the mere attachment of a diffuser to a conventional hair dryer. Further, the amount and temperature of the air flow cannot be regulated so as to provide, on the one hand, optimal drying power, and on the other hand, comfort to the scalp. Finally, the air flow is always directed toward the scalp and thus remains an irritant to the scalp.

It is thus an object of the present invention to provide a device for drying hair which makes more efficient and economical use of electricity.

It is a further object of the invention to provide a hair dryer which effectively and efficiently dries hair without at the same time impacting upon and irritating the scalp.

It is yet a further object of the invention to provide a hair drying device which is less irritative and more soothing in terms heat, air flow and noise, and which thus would be preferred for use also in animal grooming practices.

SUMMARY OF THE INVENTION

After extensive investigation and experimentation, the present inventor has discovered that the above objects can be accomplished by means of a comb-type hair dryer comprising a housing having at least one air inlet and a plurality of air discharge nozzles and defining an air-flow passage between said inlet and discharge nozzles, an air fan driven by an electric fan motor for blowing air from said inlet to said discharge nozzles, and heating means integrated within the housing for heating air flowing through the air-flow passage, wherein said discharge nozzles are in the shape of hollow projections having an open proximal end attached to said housing and in communication with the air flow passage, a closed distal end, and a side wall intermediate said proximal and distal ends, said sidewalls of said discharge nozzles provided with at least one air discharge aperture for discharging air. The main axis of the comb-type hair dryer is parallel to the scalp when in use, and the discharge apertures direct air parallel to the scalp and main axis of the comb-type hair dryer.

The significant feature of the invention is that the air heated in the hair dryer housing is never blown down onto the scalp, but is conveyed down through the hollow discharge nozzles to the level of the scalp, and only then is released and directed parallel to or upwardly away from the scalp, so as to never be directed directly onto the scalp.

In accordance with the present invention, air is drawn into the hair dryer through the at least one air inlet, is propelled by the fan over heating means where it is heated, and is discharged through the discharge apertures of the discharge nozzles parallel to the main axis of the hair dryer. Since the hair dryer, when in use, is used in a manner of a comb and is placed generally parallel to the scalp, the air discharged in accordance with the present invention is necessarily also vented parallel to the scalp. The dry heated air thus is directed mainly against the hair, picks up moisture from the hair, and carries this moisture up and away from the scalp. Only a small proportion of the dry heated air is deflected or disturbed sufficiently to actually contact the scalp. However, this small amount of contact with the scalp is much less than occasioned by conventional hair dryers, and can actually be characterized as pleasant rather than irritating.

In a preferred embodiment of the invention, the discharge openings of the discharge nozzles are all oriented in the same general direction so as to provide a general flow of air in one direction parallel to the scalp, and to thereby assist in the styling, combing, and/or untangling of hair as the hair dryer according to the present invention is brushed or combed through the hair.

It is readily apparent that the hair dryer according to the present invention can be used for long hair as well as short, and can be used to dry the hair of pets as well as the hair of humans.

The foregoing has outlined rather broadly the more pertinent and important features of the present invention in order that the detailed description that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other comb-type hair drying devices for the same purposes of the present invention. It should also be realized by those skilled in the art that such equivalent structures do not depart from the spirit and scope of the invention as set forth in the appended claims.

BRIEF DESCRIPTION OF THE DRAWINGS

Further objectives and advantages of the present invention will become apparent from a careful reading of the detailed description provided hereinbelow, with appropriate reference to the accompanying drawings.

DETAILED DESCRIPTION OF THE INVENTION

As is apparent from the above, a significant feature of the present invention resides in the use of hollow discharge nozzle projections to contain dry heated air while it travels from the hair dryer to the level of the scalp, and only then to release the air parallel to the scalp without being directed onto the scalp at any time. That is, the nozzle apertures act to direct small jets of air parallel to the scalp and/or slightly upwardly and away from the scalp.. As a result, any possibility of overheating or overdrying of the scalp due to the blowing of hot air onto the scalp is prevented. Further, the air begins flowing from the root of the hair and flows generally upwards and over the hair outwardly such that the hair is completely dried. In this way, the utilization of heat and air flow is greatly economized, and the energy requirements are correspondingly reduced.

Considering, for example, a conventional hair dryer, air flow of a significant heat content and velocity must be generated within the air dryer and be directed, from a distance, against the head. The air must be forced through the hair until it reaches the scalp, and then radiates outwardly from the impact area. In conventional hair dryers then, energy is wasted in heating the room, heating hair which has already been dried, and heating the scalp.

In contrast, when using the hair dryer in accordance with the present invention, the heated dry air is emitted from the hair dryer discharge nozzle at the level, or immediately above the level, of the scalp and is directed parallel to the scalp or upwardly such that there is no waste of air flow, no waste of heat, greatest efficiency of drying, and no irritation of the scalp. In addition, the hair dryer of the present invention permits shaping and styling of the hair, and untangles the hair as it is being dried. The comb-type hair dryer of the present invention thus represents a significant improvement over a conventional hair dryer.

The invention will now be discussed in greater detail by reference to the accompanying drawings in which non-limiting embodiments of the invention are illustrated. The invention is first discussed with respect to a preferred hair dryer which is in a shape of a palm held, dish shaped brush or comb, and which can be used in the manner of a brush or comb.

Figure 1:
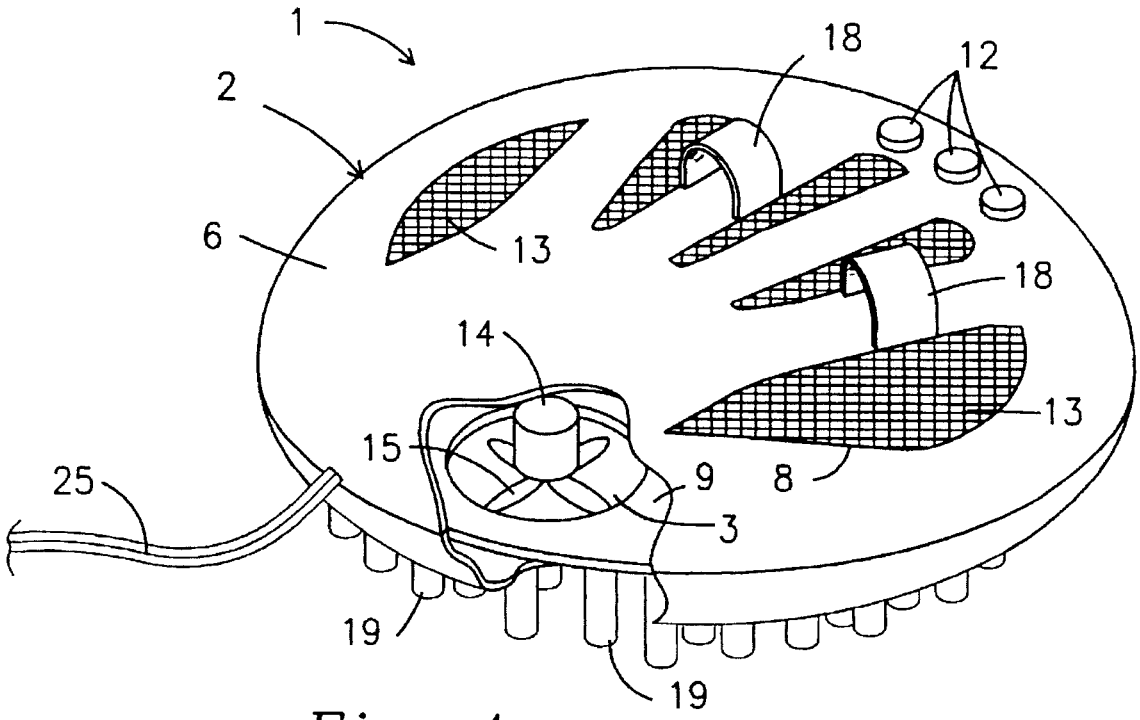
FIG. 1 is a partial cut-away isometric perspective view of a preferred hair dryer according to the invention.
Figure 2:
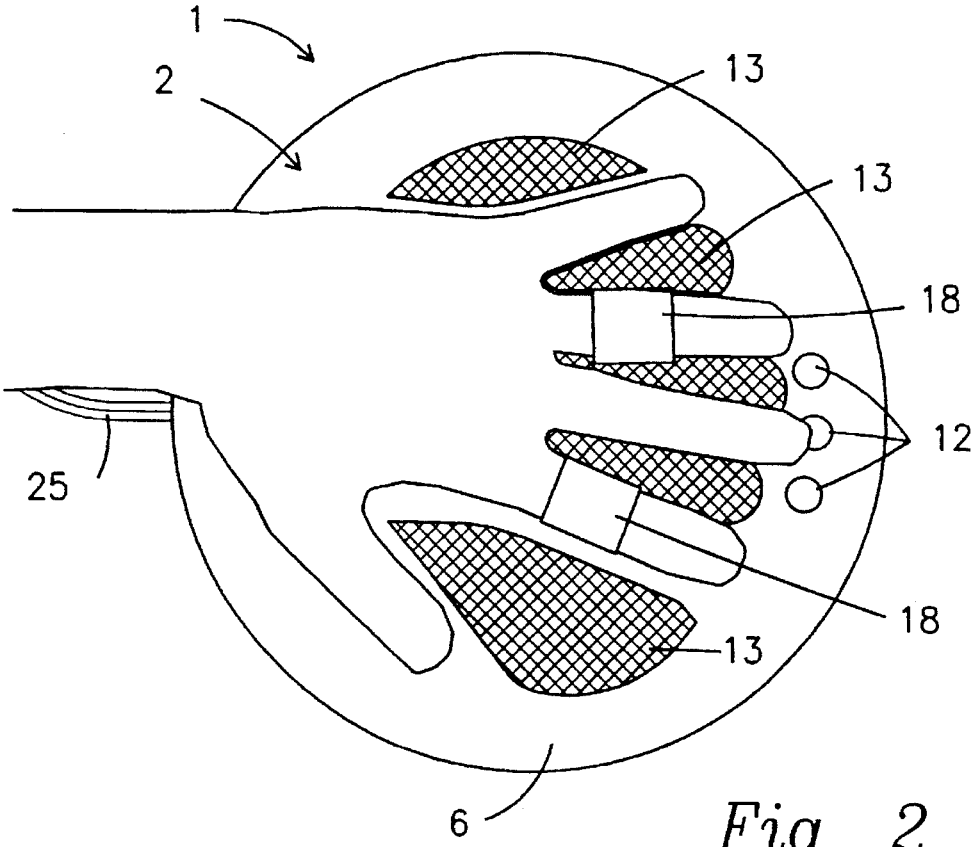
FIG. 2 is a top plan view of the hair dryer of FIG. 1 showing how it may be held by the hand.

Referring to FIG. 1, the palm shaped hair dryer is generally disc shaped and approximately the same size as, or slightly larger than, the size of a hand with fingers slightly spread (i.e., 10–14 cm). The upper side 6 of the hair dryer is gently convex and the lower side 7 of the hair dryer is gently concave in a manner to ergonomically conform to the outer contour of the human head. The outer housing may be formed of any material conventionally used in the art and capable of resisting the temperatures to which it can be expected to be subjected, and is preferably formed of a heat-resistant plastic. The housing is separated by septum 9 into an upper chamber 10 and a lower chamber 11, the upper and lower chambers communication via passageway 3. Included in the finger-tip area of the upper chamber 10 is a compartment 5 in which controls for the hair dryer are provided, with activation switches 12 accessible by the fingertips. Switches 12 shown in FIG. 1 may be, for example, an OFF switch, a lower power setting and a high power setting. Switches 12 are connected to electric motor 14 and heating element(s) 16 in a conventional manner via conventional electrically conductive means such as wires or integrated circuits.

Upper surface 6 of the housing is provided with one or more air intake, vents 8 through which air is drawn into the upper chamber. The vents may be provided with grates or filters 13 to prevent drawing of foreign objects into the housing. Not shown in the figures is the possibility of having ducts forming direct channels between the vents and fan. Electric motor 14 drives fan 15 to cause air to be drawn in through said vents 8 and for drawing the air through upper chamber 10 and exhausting the air to lower chamber 11. Once the air reaches lower chamber 11, it passes over electrical heating elements 16 and is heated.

In order to optimize the compactness of the comb-type hair dryer of the present invention, yet permit adequate air flow between upper and lower chambers, both the upper and lower chambers are preferably substantially flat across the central region of the hair dryer. However, at the palm end of the hair dryer (the side opposite the side provided with the finger tip controls), the right side of the upper chamber is enlarged to extend to the lower surface of the housing, the left side of the lower chamber is enlarged so as to reach the upper surface of the housing, and the enlarged upper (right) and lower (left) chambers are joined via a "U" shaped tube. The tube comprises an inlet and an outlet, with the inlet connecting to the upper chamber, and the outlet connected to the lower chamber. The diameter of the tube 17 generally corresponds to the distance between upper housing side 6 and the lower housing side 7. Since the inner diameter of the tube is maximized in this manner, a larger outer diameter fan blade can be used, optimizing air conveyance. That is, since the inner diameter of the tube is greater than the depth of either the upper or lower chamber, a fan blade of greater diameter can be employed than would be possible if a small fan were simply axially incorporated into either the upper or lower chamber.

The tube 17 may optionally be provided with any number of stationary blades or louvers for assisting and directing the flow of air or in preventing turbulence. Either one motor and fan blade assembly may be provided within the tube 17, or one motor and fan assembly may be provided at the inlet side of said tube and a second motor and fan assembly may be provided at the outlet side of said tube. Of course, several tubes 17 can be provided, but from an engineering perspective, a single tube is considered adequate and is preferred for ease of manufacture.

On the upper side 6 of the housing 2, in an area provided for placement of a finger, a "D" ring shaped solid member may be provided through which a finger can be inserted for securely holding the comb-type dryer against the palm of the hand. Alternatively, the means for holding the comb on the hand can be VELCRO strips for individual fingers, cloth members with snap fasteners for individual fingers, or a single VELCRO type strap may be provided extending from side to side of the housing so as to fit over the entire hand. Once the size of the VELCRO loop has been set to be only slightly loose, the loop may remain in the set configuration and the fingers may be inserted into the cloth loops for use and slid out of the cloth loops when the operator has finished drying his hair.

Alternatively, in the case that the comb is constructed small enough to be grasped by the hand, the means for attaching the comb to the hand can be dispensed with.

The hair dryer may be powered by 110 volt or 220 volt alternating current via electrical cord 25, or given a battery of sufficient power, may be powered by internal batteries. The hair dryer may also be provided with a cigarette lighter adapter and may be plugged directly into the cigarette lighter of an automobile to be powered by the 12 volt electrical power supply of an automobile. In the event that the hair dryer is powered by an external source, the segment of the power cord nearest the hair dryer may be made thicker or stiffer so as to urge the cord away from the area being combed. The cord may be connected to the hair dryer via a swivel connection, or may be provided with any modification conventional in the hair drying art.

Any of the electrical heating elements for use in hair dryers known to those working in the art may be used in the hair dryer of the present invention, and as these are well known, need not be described herein in detail. The most common electrical heating elements used in hair dryers are helical resistance conductors, such as chromed alloyed electric heating wires or coils. Included in the electrical circuit of such heating elements are temperature regulating bimetallic cutout elements, which break contact as the temperature increases beyond a predetermined point. Further, positive-temperature-coefficient (PTC) semiconductor heating units as disclosed in U.S. Pat. No. 5,243,683 to Yang may be preferred for certain applications.

Figure 7:
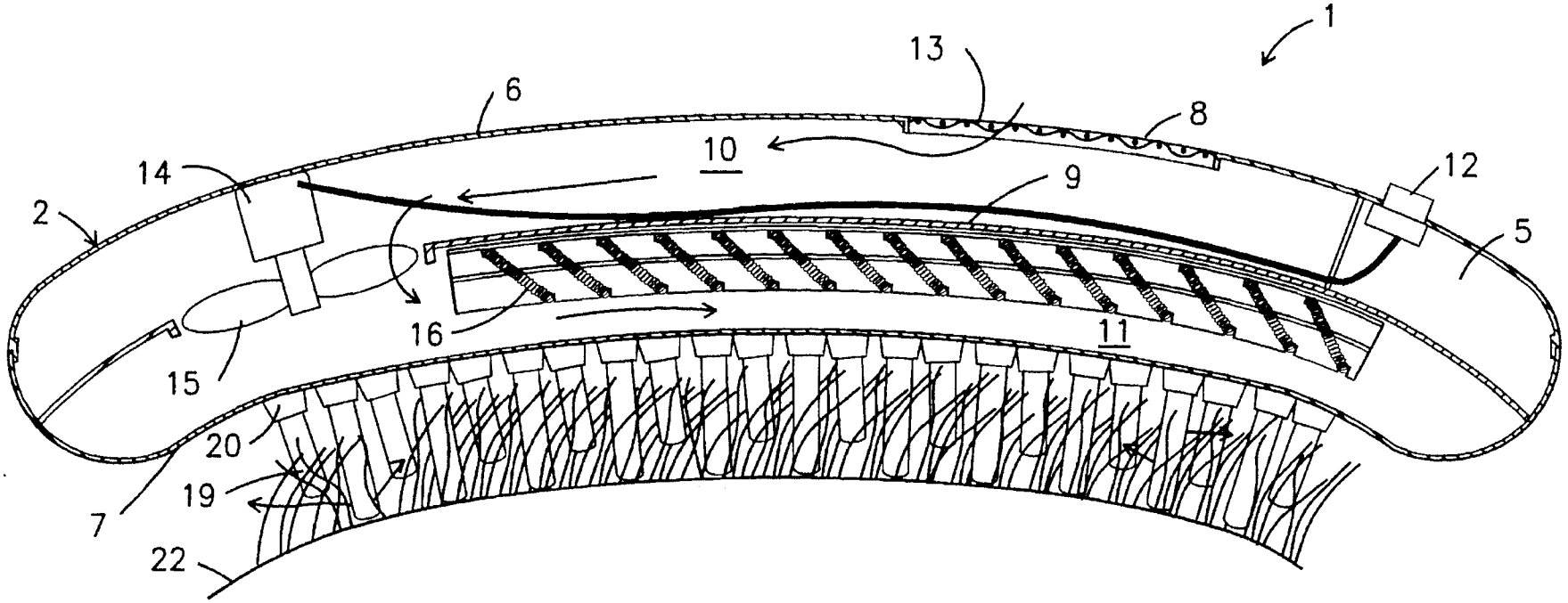
FIG. 7 is a side cross-sectional representation with heating elements provided in the housing.
Figure 8:
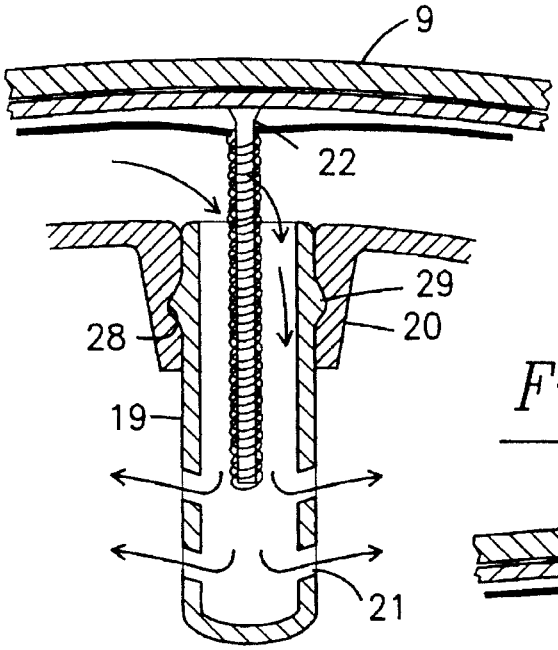
FIG. 8 is an enlarged representation of a first embodiment of a discharge nozzle with a heating element provided in the discharge nozzle.
Figure 9:
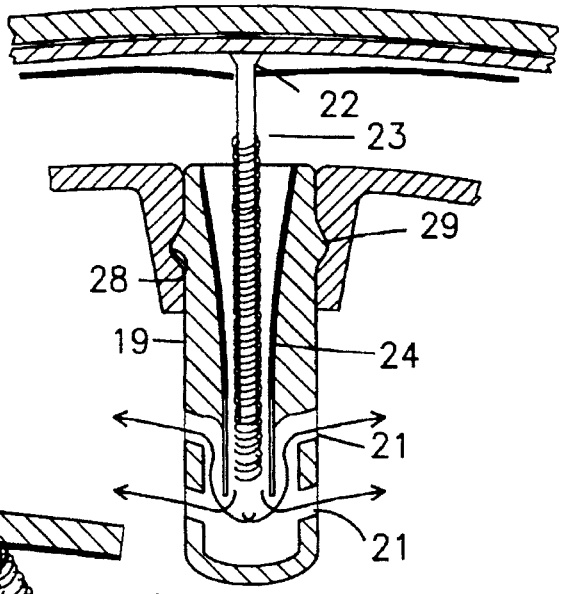
FIG. 9 is an enlarged representation of a second embodiment of a discharge nozzle with a heating element provided in the discharge nozzle.
Figure 10:
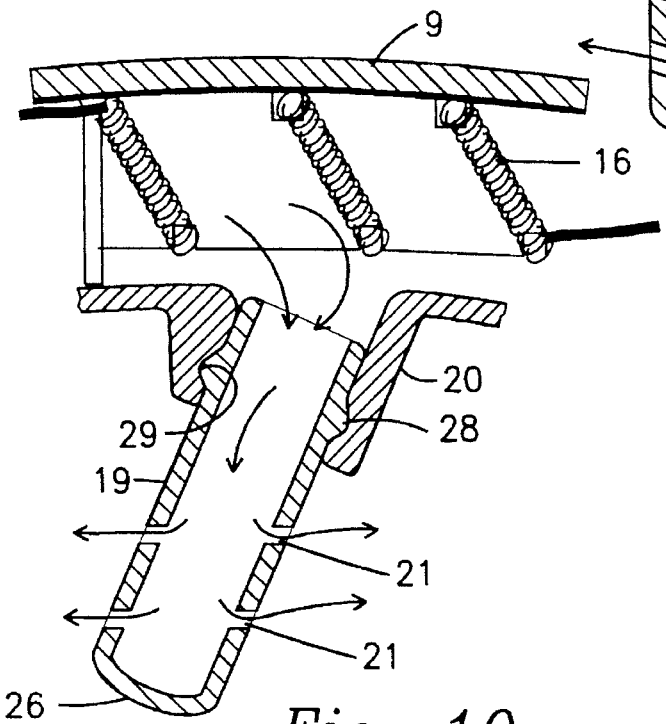
FIG. 10 is an enlarged representation of a first embodiment of a discharge nozzle with a heating element provided in the hair dryer housing.

Various designs and arrangements of heating elements are within the contemplation of the present invention. For example, as shown in FIG. 7, a lower chamber 11 may have coiled inductive wires arranged therein in a manner to optimize both air flow and heat exchange between the air and the heating element(s). Lower chamber 11 receives air and distributes it to a plurality of downwardly directed openings 18 on the lower surface 7 of the housing 2. Hollow generally cylindrically shaped discharge nozzles 19 extend generally perpendicularly from said housing 2 lower surface 7. The discharge nozzles 19 have a closed distal end and an open proximal end, the open proximal end being in communication with lower chamber 11. In the embodiments shown in FIGS. 7 and 10, heating element 16 is provided within lower chamber 11. Air, once heated in the lower chamber 11 exits the lower chamber through openings 18 provided in the lower surface of the housing 7, through the therein recessed discharge nozzle 19, and is finally vented out at least one air discharge aperture 21 located along the side wall of said discharge nozzle 19. The air discharge apertures 21 may be oriented so as to direct the flow of drying air slightly upwardly away from the scalp as shown in FIG. 9, but are preferably parallel to the main body of the hair dryer 1 and thus also parallel to the scalp 22 as shown in FIGS. 8 and 10.

The discharge nozzles 19 may be made of any suitable material, but for ease of manufacture are preferably comprised of a slightly flexible, heat resistant plastic. The discharge nozzles 19 may be formed integrally with the lower surface 7 of the housing 2, or the discharge nozzles 19 may be separate elements attached to the housing 2 by any means such as external threading adapted to screwing into internal threading in orifices in the housing (not shown) or snap fittings (as shown in FIGS. 8–10). That is, the housing 1 may be provided with orifices 18 surrounded by areas of slight thickening or strengthening so as to form short hollow cylindrical receptacles 20. Within the receptacles 20 are internal annular grooves or recesses 28. Adjacent to the proximal ends of the discharge nozzles are flanges or projections 29 adapted to engaging the recesses 28. With such a construction, discharge nozzles 19 may be easily introduced into or removed from the receptacles 20, discharge nozzles of one design or length may be substituted for discharge nozzles of a different design or length, broken discharge nozzles may be replaced, and, due to the cylindrical design, the discharge nozzles may be rotated about their axis to direct the air flow in any desired direction. All discharge apertures 21 may be aimed in the same direction to permit neat grooming of hair, or the discharge apertures 21 may be aimed in different directions to give a tussled appearance to the hair.

Discharge nozzles 19 provided with single discharge apertures 20 may be replaced with discharge nozzles with a plurality of discharge apertures, and each of these plurality of apertures may be provided on the same side of the discharge nozzle so as to be provided at different distances from the scalp, or the plurality of apertures may be arranged around the circumference of the discharge nozzles so as to direct air in various directions.

The size and shape of the discharge apertures 20 is not particularly limited, but it is preferred that they be sufficiently large so as to permit venting of hot air yet preventing entry of hair into the hollow discharge nozzle. The discharge apertures are preferably rounded so as to have no sharp corners capable of snagging or entanglement with hair.

Figure 11:
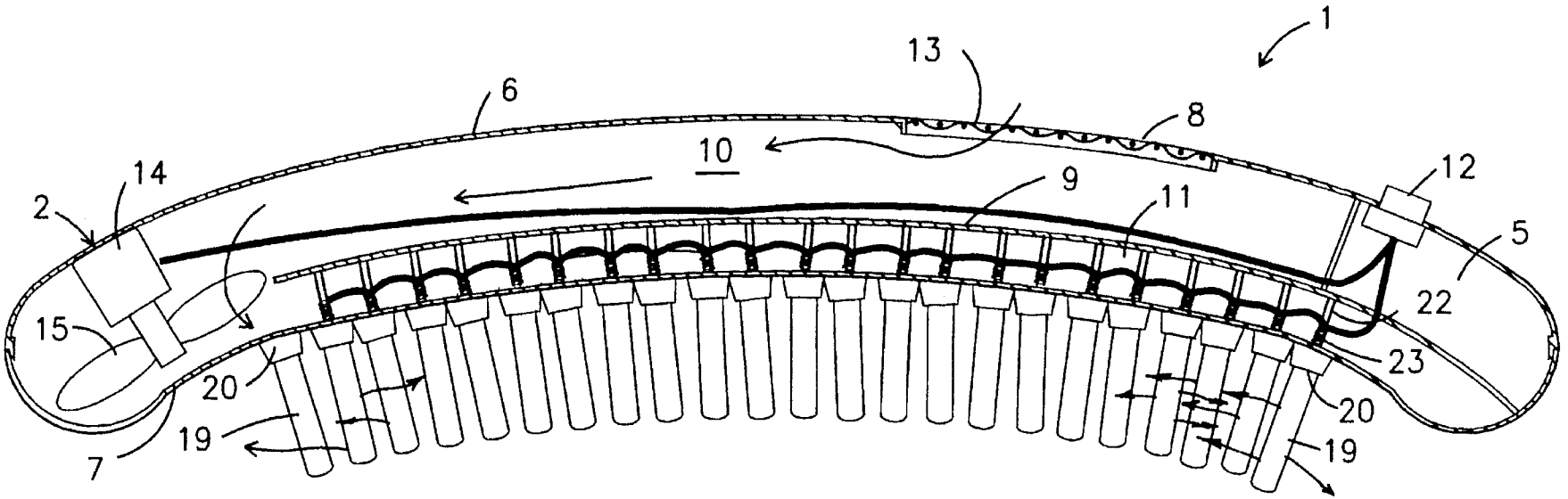
FIG. 11 is a side cross-sectional representation with heating elements provided in the discharge nozzles.
Figure 12:
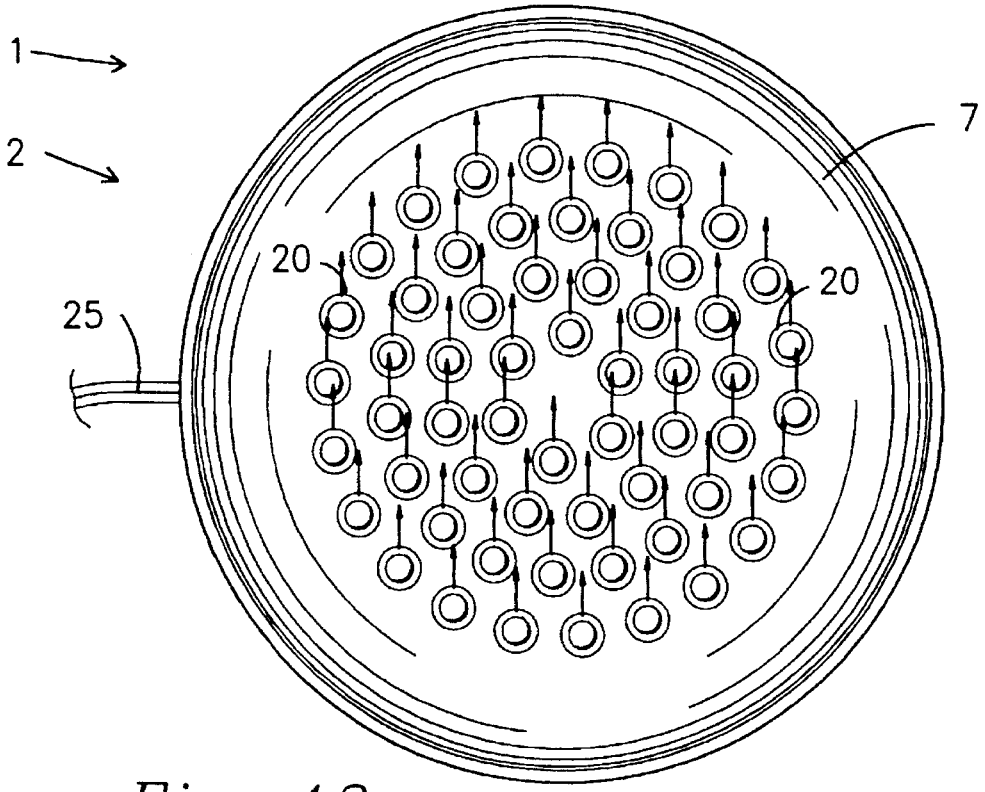
FIG. 12 is a bottom view of a hair dryer with discharge apertures directing air flow in a single direction.
Figure 13:
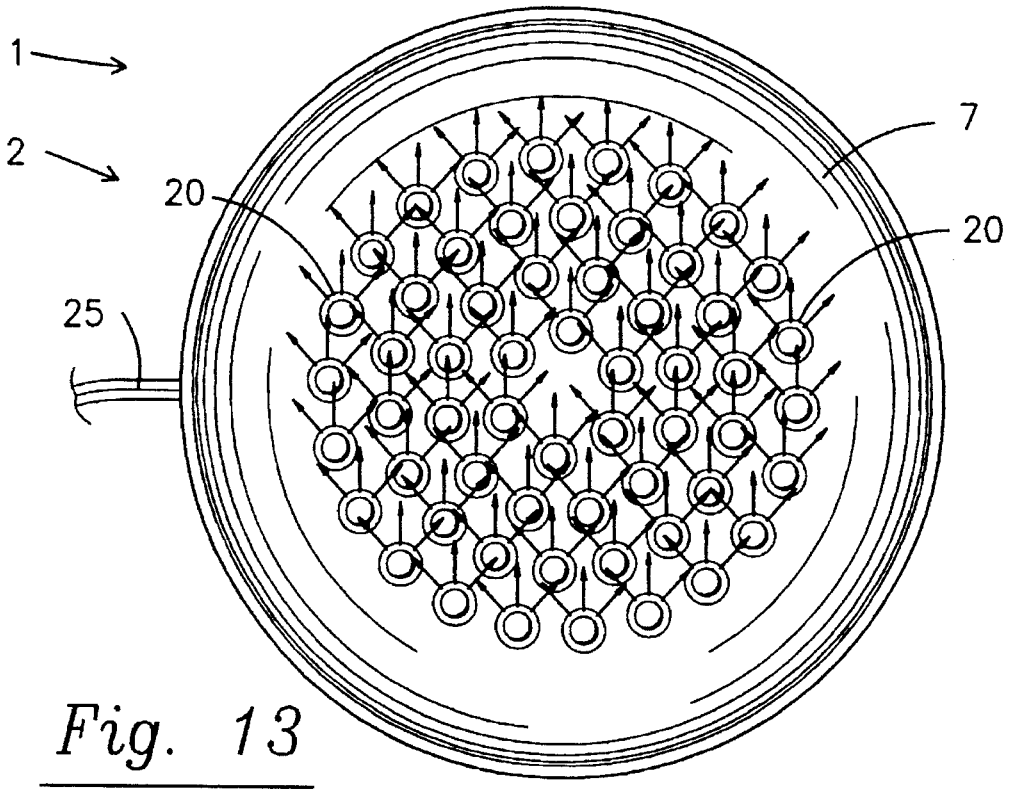
FIG. 13 is a bottom view of a hair dryer with discharge apertures directing air flow in three directions.
Figure 14:
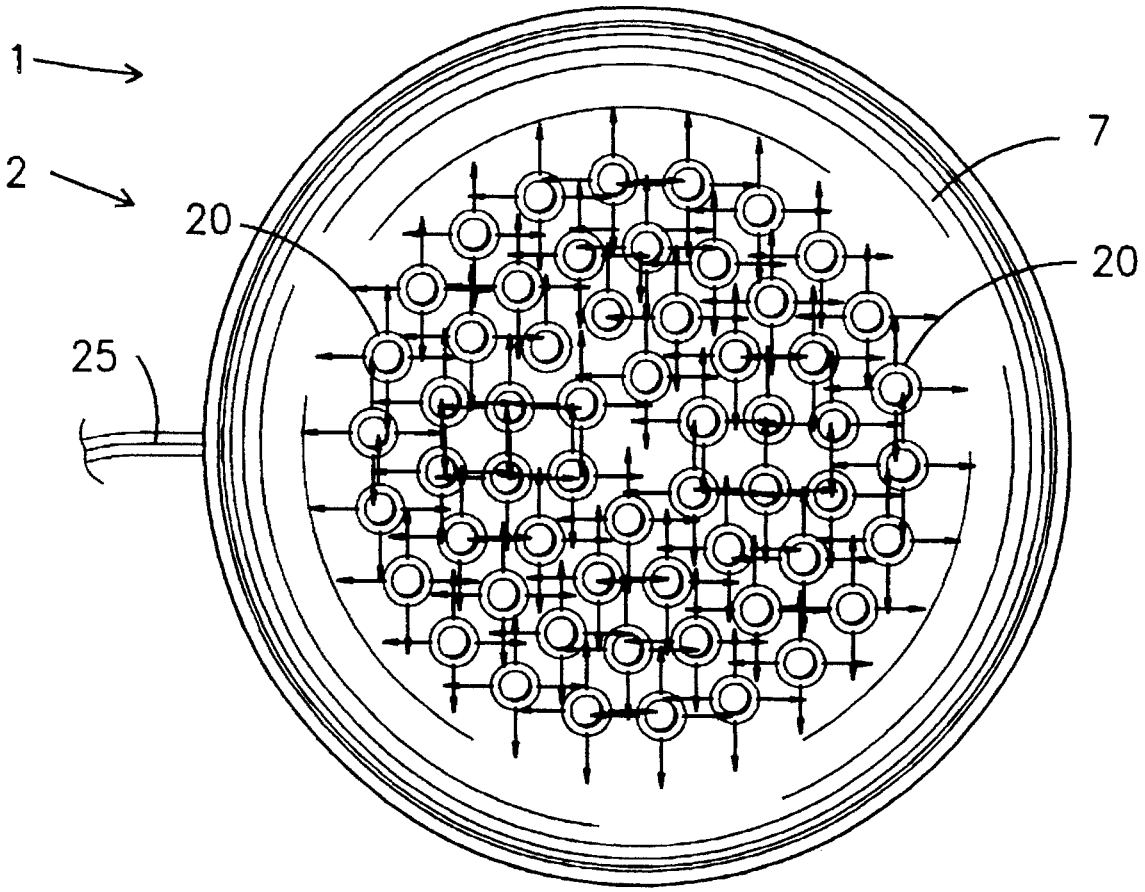
FIG. 14 is a bottom view of a hair dryer with discharge apertures directing air flow in four directions.

FIG. 7 shows the approximate relationship between upper chamber 10 and lower chamber 11 when electrical heating elements are provided within lower chamber 11. A further embodiment of the present invention, wherein it is desired to make the housing 2 of the comb-type hair dryer 1 as thin as possible, is shown in FIGS. 8 and 11. Heating elements are provided so as to enter into said hollow discharge nozzles members 19. As shown in detail in FIG. 8, a downwardly projecting heat resisting member 22 projects from septum 9 into the discharge nozzle 19. Electrical heating coil 23 is provided on the heat resisting member 22 and is arranged so as to heat air as air passes from the housing lower chamber 11 into the discharge nozzle 19. As can be seen from FIG. 11, since lower chamber 11 no longer houses electrical heating element 16, lower chamber 11 can be made thinner than in the first embodiment described above in association with FIG. 7, and accordingly the entire housing 2 can be made to have a more compact appearance.

FIG. 9 shows a more preferred embodiment of the invention wherein heating element 23 extends almost the entire length of discharge nozzle 19, and wherein discharge nozzle 19 is provided with internal auxiliary air directing louvers or fins 24 which ensure that air flows over the entire heating element prior to leaving the discharge nozzle through the discharge aperture 21. This is done by arranging the fin(s) 24 so as to ensure that air traveling downward past said electrical heating element 23 comes into close contact with said electrical heating element and travels to the distal end of the discharge nozzle before being redirected upwardly, through a separate channel, prior to exiting through the discharge aperture(s) 21. That is, the air flow passageway within said tooth member 19 is essentially increased by, e.g., 50%, by having the air first flow in one direction down past the electrical heating element for the entire length of the discharge nozzle, then being redirected and flowing upwardly prior to being discharged from the discharge aperture. An incidental advantage attributable to the presence of air flow directing fins 24 is that they shield electrical element 23 from any foreign matter entering in through discharge apertures 21, including hair, and thus prevent contact between wet hair and the electrical heating element.

It will be readily understood from FIG. 9 that the air flow controlling fins 24 may be in the shape of an internal funnel coaxial with the central axis of the discharge nozzle in the case that exhaust vents are provided around the periphery of the tooth member 19. Alternatively, a single air flow controlling fin may be provided along only one side of the electrical heating element 23 in the case that exhaust vent(s) 21 are provided along only one side of the, discharge nozzle 19.

It will be readily apparent that in certain embodiments of the invention discharge nozzles 19 may all be the same length, and in other embodiments of the invention two or three or more lengths of discharge nozzles may be mixed or arranged in various patterns, so as to give different degrees of drying and combing as desired for a given hair styling technique.

The precise internal and external dimensions of the discharge nozzles may be varied in order to achieve different air flow rates and different combing properties. For example, in the case that it is desired to groom an animal having a long and stiff coat, the external cross section of the discharge nozzles may be dimensioned larger than that for a conventional adult. In the case that it is desired to dry the hair of an infant or elderly person with fine hair, the external diameter of the discharge nozzles are preferably reduced. In general, an external diameter of 0.7 to 1.2 cm would be found acceptable by most consumers for most uses. The length of discharge nozzles may also be varied depending upon the application, and in general discharge nozzles having a length of from 1.0 to 3.0 cm, most preferably, about 2.0 cm, are preferred for combing human hair.

Figure 3:
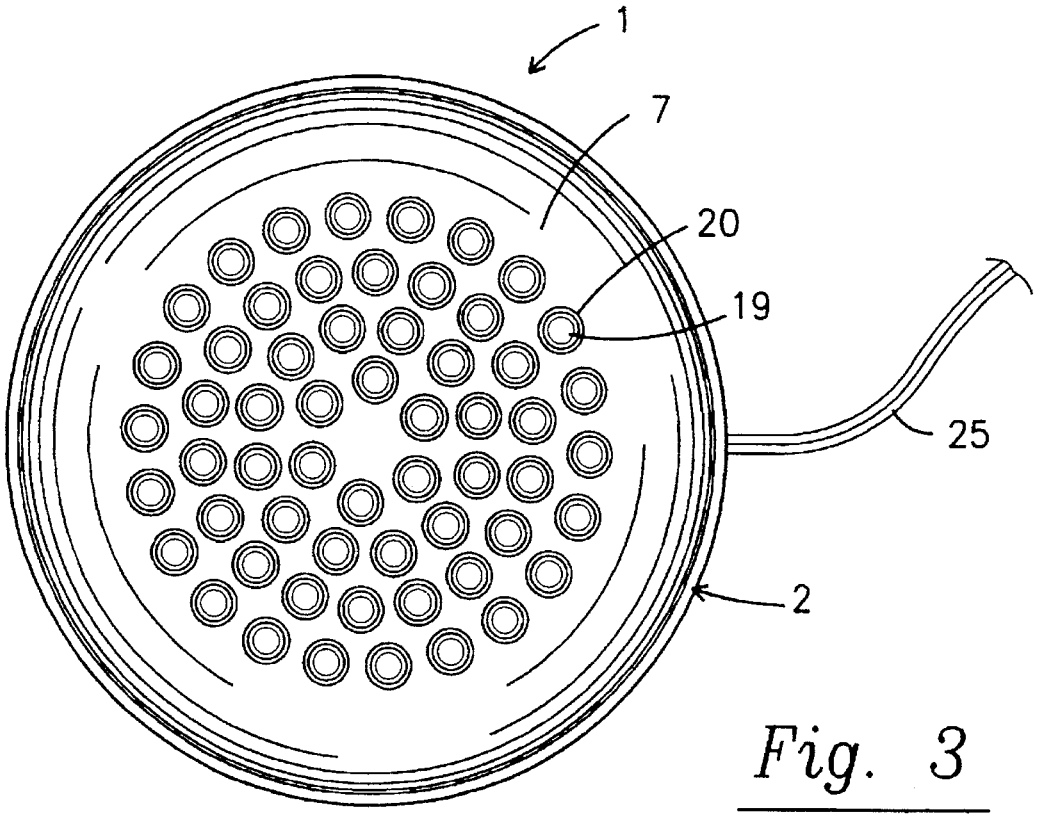
FIG. 3 is a bottom plan view of the hair dryer of FIG. 1.
Figure 4:
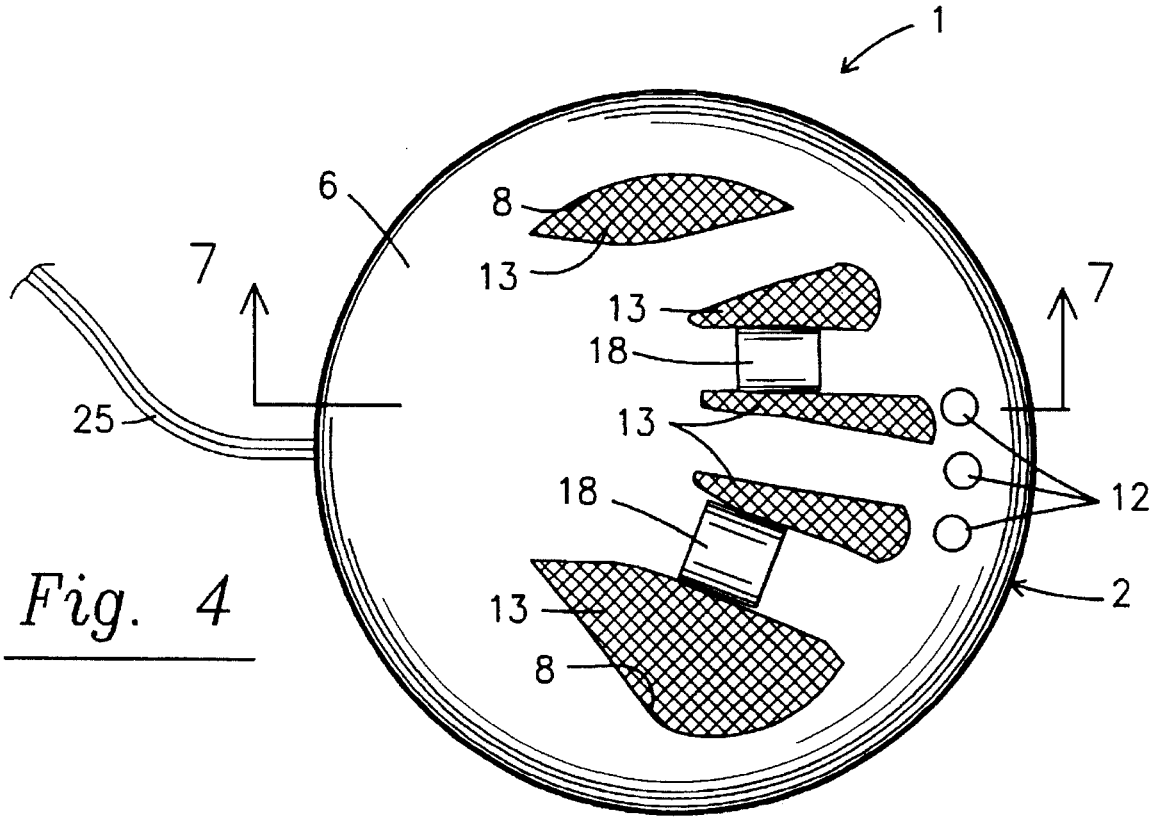
FIG. 4 is a top plan view of the hair dryer corresponding to FIG. 2, with the hand removed.
Figure 5:
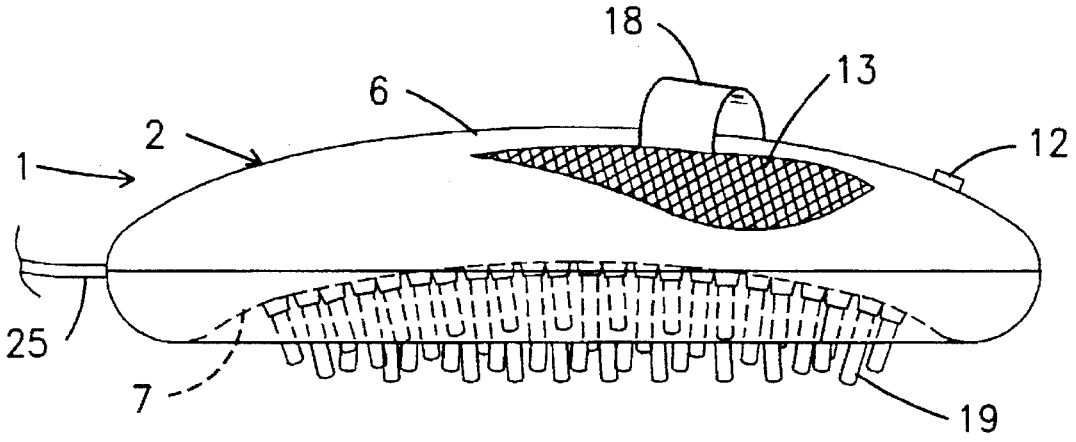
FIG. 5 is side view of the hair dryer of FIG. 1.
Figure 6:
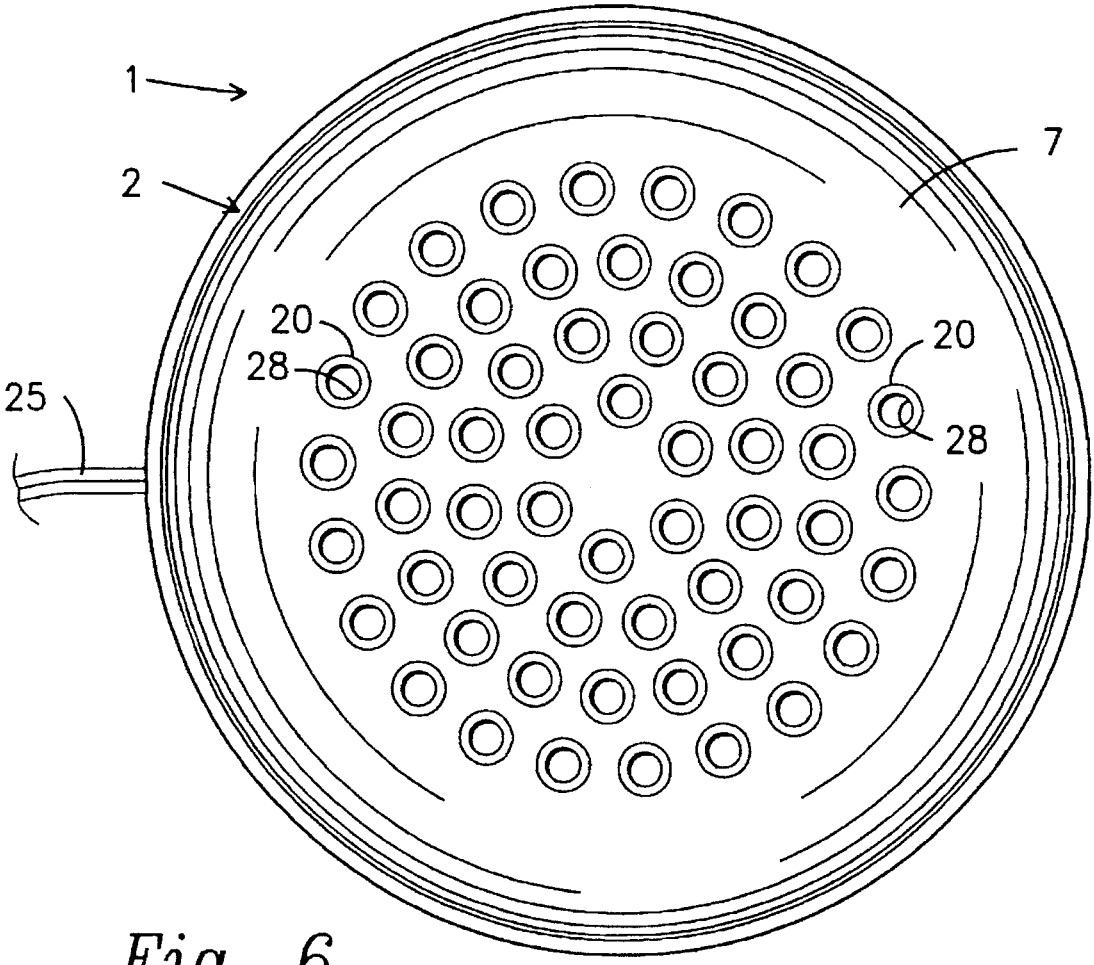
FIG. 6 is a bottom plan view of the hair dryer corresponding to FIG. 1, but with discharge nozzles removed.

The number of discharge nozzles 19 is not particularly limited, and may be 60–100 or more in the case of a large palm held comb as shown in FIG. 1, or may be as few as 5 to 10 in the case of an extended linear comb. Discharge nozzles in an extended linear comb may be coplanar, or may be provided in several rows generally radially from a central longitudinal axis of the comb. Generally, 15-20 is considered to provide an optimal balance between air flow, combing effect, ease of manufacture, and comfort. The spacing of discharge nozzles 19 in a disk shaped hair dryer as shown in FIG. 3 may be varied depending on the type of hair to be dried and may be any design which is aesthetically pleasing.

Further alternative embodiments of the present invention may be easily envisioned. For example, the comb may take the appearance of a conventional comb with a row of symmetrical discharge nozzles projecting downwardly from a wand-like upper housing member. Alternatively, discharge nozzles may be staggered or placed in a zig-zag pattern along the lower surface of an upper housing so as to provide structural elements of both a comb and a brush.

In yet another embodiment of the present invention, the tooth members 19 which are shown projecting perpendicularly from the housing in FIGS. 7 and 11 may all be inclined in a certain direction, namely, in the direction in which it is intended to drawn the comb through the hair. The discharge nozzles are inclined so that the leading edges catch and lift the hair as the comb is being drawn through the hair. Even in this case, however, the discharge aperture is consistently provided so as to emit hot drying air only parallel to the surface of the scalp or upwards and away from the scalp. Accordingly, the range of rotation of the discharge nozzle and the associated discharge aperture will have to be restricted by suitable means such as stops, tabs, bumpers, etc.

A significant difference between the present invention and the prior art is that, even where the prior art provides finger like projections for spacing the hair dryer or diffuser from the head, in all cases the flow of drying air is directed downward onto the hair and scalp. In the present invention, discharge nozzles are provided for delivering hot dry air to the level of the scalp, and discharge apertures are provided for directing hot drying air released at the level of the scalp parallel to or away from the scalp.

Yet a further embodiment of the invention comprises a hair dryer with the same external appearance and air flow pattern as discussed above and as shown in FIG. 1, but with the single difference that the entire lower housing segment, including discharge nozzles, is separable from the remainder of the hair dryer (i.e., upper chamber, heating elements, controls, fan unit, power cords. etc.). The advantage of such an embodiment is that different discharge nozzle configurations can be readily changed out. For example, a consumer may desire to purchase a single hair dryer with three separate discharge nozzle/lower segment units: one lower segment unit with a set of nozzles configured for long hair, a second lower segment unit with a set of nozzles configured for short hair, and a third lower segment unit with a set of nozzles configured for an animal such as a dog.

As will be readily understood from the above, the device according to the present invention overcomes the problem associated with conventional hair dryers, namely, the problem of direct application of heat and dry air to the scalp, and thus avoid irritation of and damage to the scalp. This is accomplished by ensuring that all air and heat is contained within a discharge nozzle until it reaches the level of the scalp, and is then released directed parallel to or away from the scalp. Obviously, in the case that air is directed parallel to the scalp and released near the scalp, some minor amount of air will necessarily diffuse or be disturbed by turbulence and thus incidentally contact the scalp. However, this proportion is minor, and will actually feel good on the scalp rather than be perceived as irritating as in the case of a conventional hair dryer. In fact, the palm-held comb-type hair dryer according to the present invention when used as intended feels as though it is providing a gentle scalp massage.

The closed distal end 26 of the discharge nozzles may be comprised of the same material or of a different material than comprises the cylindrical body of the discharge nozzle, but the distal end is preferably made of a material which is heat insulated so as to protect the scalp from the internal heat of the hair dryer, soft or smooth so as to feel comfortable on the scalp, and easy to clean. In a preferred embodiment, the distal ends are designed to provide a gentle scalp massage while combing and drying the hair according to the present invention.

Discharge nozzle configuration and dimensions, discharge aperture orientation, number and size of discharge apertures per discharge nozzle, number of discharge nozzles placement of heating elements and internal ducting can all be varied in terms of permutations and combinations to achieve all possible requirements for the drying of human hair, pet hair, or any other industrial application where fibers or filamentous material must be dried of moisture or any other volatile liquids while attempting to protect an underlying surface.

Although this invention has been described in its preferred form with a certain degree of particularity with respect to a disk shaped, palm held, comb type hair dryer, it is understood that the present disclosure of the preferred form has been made only by way of example and that numerous changes in the details of structures may be resorted to without departing from the spirit and scope of the invention.

Now that the invention has been described,

What is claimed is:

1. A comb-type hair dryer comprising:

a housing having at least one air inlet and a plurality of air discharge nozzles and defining an air-flow passage between said inlet and discharge nozzles, said housing defining at least one main axis, said hair dryer housing being in the general shape of a disk having a top side and a bottom side, wherein said at least one air inlet is provided on the top side of said disk, and wherein said plurality of discharge nozzles are provided on the bottom side of said disk, and wherein said bottom side of said disk shaped hair dryer housing is gently concave in a manner to ergonomically conform said distal ends of said discharge nozzles to the outer contour of the human head;

an air fan driven by an electric fan motor for blowing air from said inlet to said discharge nozzles; and heating means integrated within the housing for heating air flowing through the air-flow passage;

wherein said discharge nozzles are in the shape of hollow projections having an open proximal end attached to said housing and in communication with the air flow passage, a closed distal end, and a side wall intermediate said proximal and distal ends, said side walls of said discharge nozzles provided with at least one air discharge aperture for discharging air parallel to the main axis of the comb-type hair dryer.

2. A comb-type hair dryer as in claim 1, further including receptacles adapted to receiving fingers on the top of said disk shaped hair dryer housing.

3. A comb-type hair dryer as in claim 1, wherein said housing is divided into an upper chamber and a lower chamber by a septum, wherein said upper chamber communicates with said air inlet vent, said lower chamber communicates with said plurality of air discharge nozzles, wherein said septum is provided with a channel communicating between said upper and lower chambers, and wherein said air fan is provided so as to convey air between said upper and lower chambers.

4. A comb-type hair dryer as in claim 3, wherein said heating elements are provided in said lower chamber.

5. A comb-type hair dryer as in claim 3, wherein said heating means is a plurality of heating elements, and wherein said heating elements are individually provided within respective discharge nozzles.

6. A comb-type hair dryer as in claim 3, wherein said channel communicating between said upper and lower chambers is an aperture in said septum.

7. A comb-type hair dryer as in claim 3, wherein said channel communicating between said upper and lower chambers is a U-shaped tube.

8. A comb-type hair dryer as in claim 1, wherein said discharge nozzles project from said housing substantially perpendicularly to said main axis of said housing.

9. A comb-type hair dryer as in claim 1, wherein said discharge nozzles project from said housing slanted at an angle of from 5°–45° from perpendicular to said main axis of said housing.

10. A comb-type hair dryer as in claim 1, wherein said air fan and said heating means are powered by 12 volt direct current.

11. A comb-type hair dryer as in claim 1, wherein said heating means is one or more chromed alloyed electric heating wires or coils.

12. A comb-type hair dryer as in claim 1, wherein said heating means is one or more positive temperature-coefficient semiconductor heating units.

13. A comb-type hair dryer as in claim 1, wherein said discharge nozzles are generally cylindrical about a central axis, and wherein said discharge nozzles are attached to said housing of said hair dryer so as to be rotatable about said axis.

14. A comb-type hair dryer as in claim 13, wherein said discharge nozzles are removable and replaceable.

15. A comb-type hair dryer as in claim 14, wherein said housing is provided with orifices the edges of which are thickened so as to form short hollow cylindrical receptacles, wherein said receptacles are provided with internal annular recesses, and wherein proximal ends of the discharge nozzles are provided with flanges adapted to engaging said recesses.

16. A comb-type hair dryer as in claim 1, wherein said discharge nozzles are of at least two different lengths.

* * * * *